US011187048B2

(12) United States Patent
Gaskins et al.

(10) Patent No.: US 11,187,048 B2
(45) Date of Patent: Nov. 30, 2021

(54) SINGLE PIECE GUIDES

(71) Applicant: Swift Lock Guides, LLC, Knott, TX (US)

(72) Inventors: Dustin Gaskins, Knott, TX (US); Ryan Gernentz, Midland, TX (US)

( * ) Notice: Subject to any disclaimer, the term of this patent is extended or adjusted under 35 U.S.C. 154(b) by 0 days.

(21) Appl. No.: 16/803,996

(22) Filed: Feb. 27, 2020

(65) Prior Publication Data

US 2020/0199945 A1 Jun. 25, 2020

Related U.S. Application Data

(63) Continuation-in-part of application No. 15/789,801, filed on Oct. 20, 2017, now Pat. No. 10,619,427.

(60) Provisional application No. 62/410,604, filed on Oct. 20, 2016.

(51) Int. Cl.
*E21B 17/10* (2006.01)

(52) U.S. Cl.
CPC ..... *E21B 17/1071* (2013.01); *E21B 17/1078* (2013.01)

(58) Field of Classification Search
CPC ..... E21B 17/1071; E21B 17/1078
See application file for complete search history.

(56) References Cited

U.S. PATENT DOCUMENTS

| | | | | |
|---|---|---|---|---|
| 1,535,336 | A * | 4/1925 | Nixon | E21B 17/1071 166/241.4 |
| 3,063,760 | A * | 11/1962 | Gifford | E21B 17/1042 175/325.5 |
| 5,247,990 | A | 9/1993 | Sudol et al. | |
| 5,941,312 | A * | 8/1999 | Vermeeren | E21B 17/1071 166/241.2 |
| 2002/0092647 | A1 | 7/2002 | Terry | |
| 2004/0011561 | A1 | 1/2004 | Hughes | |

* cited by examiner

*Primary Examiner* — Giovanna Wright
(74) *Attorney, Agent, or Firm* — Shannon Warren

(57) ABSTRACT

A rod guide for guiding and protecting a sucker rod in a fluid mineral extraction setting. The rod guide comprising a bore shell, and a guide bore, a first end, a second end, one or more glue ports, a plurality of glue dams and a plurality of flutes. The bore shell wraps around the guide bore. The bore shell comprises an outside surface and an inside surface. The plurality of flutes are arranged around the bore shell extending outward from a central axis. The plurality of flutes are configured to prevent the sucker rod from rubbing within a tubing, as the sucker rod is inserted and withdrawn from said tubing the rod guide and the guide bore comprises the central axis.

12 Claims, 16 Drawing Sheets

SINGLE PIECE GUIDES

CROSS-REFERENCE TO RELATED APPLICATIONS

This application claims benefit to U.S. patent application Ser. No. 15/789,801 filed 2017 Oct. 20, and 62/410,604 filed 2016 Oct. 20.

STATEMENT REGARDING FEDERALLY SPONSORED RESEARCH OR DEVELOPMENT (IF APPLICABLE)

Not applicable.

REFERENCE TO SEQUENCE LISTING, A TABLE, OR A COMPUTER PROGRAM LISTING COMPACT DISC APPENDIX (IF APPLICABLE)

Not applicable.

BACKGROUND OF THE INVENTION

No prior art is known to the Applicant; however, these applications were cited by the parent application's Examiner: US2004011561A1, U.S. Pat. No. 5,247,990A, and US20020092647A1.

BRIEF SUMMARY OF THE INVENTION

A rod guide for guiding and protecting a sucker rod in a fluid mineral extraction setting. Said rod guide comprising a bore shell, and a guide bore, a first end, a second end, one or more glue ports, a plurality of glue dams and a plurality of flutes. Said bore shell wraps around said guide bore. Said bore shell comprises an outside surface and an inside surface. Said plurality of flutes are arranged around said bore shell extending outward from a central axis. Said plurality of flutes are configured to prevent said sucker rod from rubbing within a tubing, as said sucker rod is inserted and withdrawn from said tubing said rod guide and said guide bore comprises said central axis. Said plurality of flutes comprises a flute diameter as measured outward from said central axis. Said bore shell comprises a shell diameter. Said guide bore comprises an inner bore diameter and an outer bore diameter. Said inner bore diameter is substantially the same or minimally larger than an outer rod diameter of said sucker rod. Said one or more glue ports each comprise an aperture in said bore shell creating a fluid channel into said guide bore. Said plurality of glue dams are arranged about said inside surface of said bore shell. Said one or more glue ports are arranged between said plurality of glue dams in said bore shell to allow an adhesive to enter an adhesive channel. Said adhesive channel can comprise a channel between said sucker rod, said bore shell, and said plurality of glue dams. Said one or more glue ports each comprise one or more port diameters. Said one or more port diameters can taper down as between said outside surface and said inside surface of said bore shell. Said plurality of flutes comprise at least a first flute, a second flute and a third flute. Said bore shell comprise a cylindrical shape with open ends at said first end and said second end.

Said rod guide for guiding and protecting said sucker rod in a fluid mineral extraction setting. Said rod guide comprising said bore shell, and said guide bore, said first end, said second end, said one or more glue ports, said plurality of glue dams and said plurality of flutes. Said bore shell wraps around said guide bore. Said bore shell comprises said outside surface and said inside surface. Said plurality of flutes are arranged around said bore shell extending outward from said central axis. Said plurality of flutes are configured to prevent said sucker rod from rubbing within a tubing, as said sucker rod is inserted and withdrawn from said tubing said rod guide and said guide bore comprises said central axis. Said plurality of flutes comprises said flute diameter as measured outward from said central axis. Said bore shell comprises said shell diameter. Said guide bore comprises said inner bore diameter and said outer bore diameter. Said inner bore diameter is substantially the same or larger than said outer rod diameter of said sucker rod. Said one or more glue ports each comprise an aperture in said bore shell creating a fluid channel into said guide bore. Said plurality of glue dams are arranged about said inside surface of said bore shell. Said one or more glue ports are arranged between said plurality of glue dams in said bore shell to allow said adhesive to enter said adhesive channel. Said adhesive channel can comprise a channel between said sucker rod, said bore shell, and said plurality of glue dams.

DETAILED DESCRIPTION OF THE INVENTION

The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1:
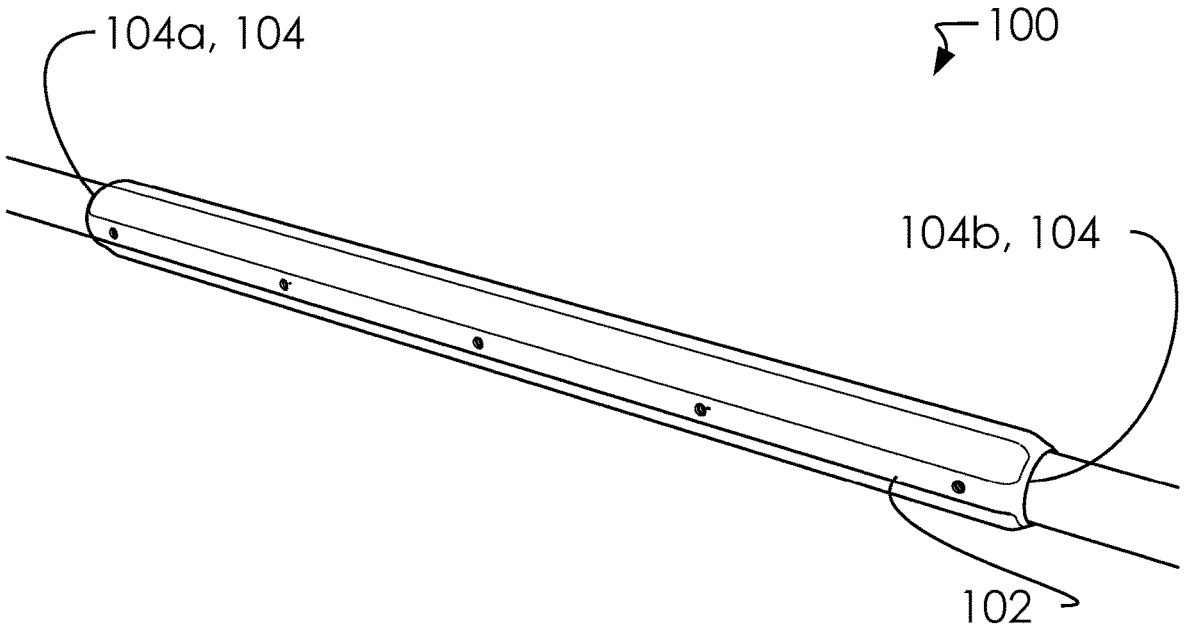
FIG. 1 illustrates a perspective overview of a rod guide 100.

FIG. 1 illustrates a perspective overview of a rod guide 100.

In one embodiment, said rod guide 100 can selectively attach around a sucker rod 102. Said rod guide 100 can comprise a two ends 104 which can comprise a first end 104*a* and a second end 104*b*.

Figure 2A:
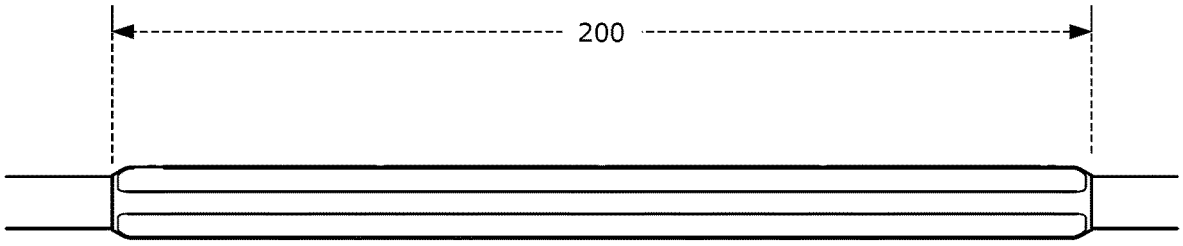
FIGS. 2A and 2B illustrate an elevated top view and side view of said rod guide 100 on a sucker rod 102.
Figure 2B:
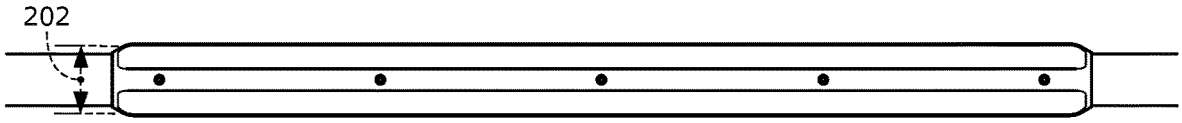

FIGS. 2A and 2B illustrate an elevated top view and side view of said rod guide 100 on said sucker rod 102.

In one embodiment, said rod guide 100 can comprise a guide length 200 and a guide diameter 202.

Figure 3A:
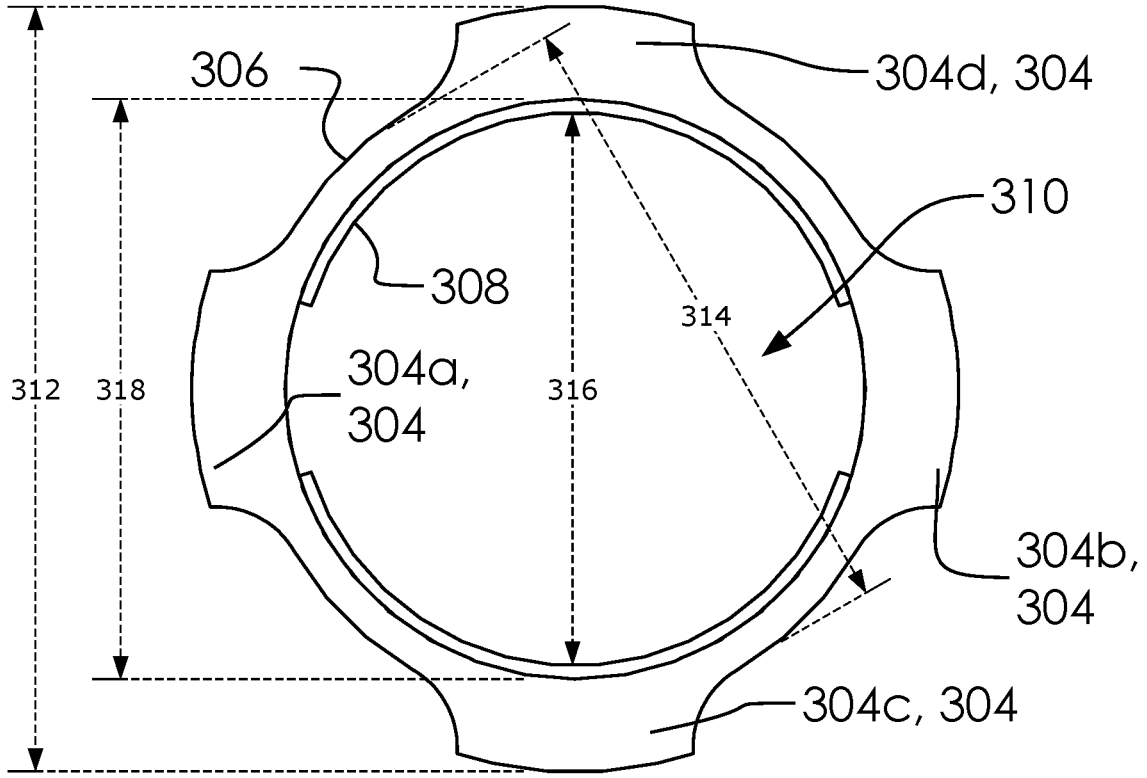
FIGS. 3A and 3B illustrate an elevated front view of said rod guide 100, with and without said sucker rod 102, respectively.
Figure 3B:
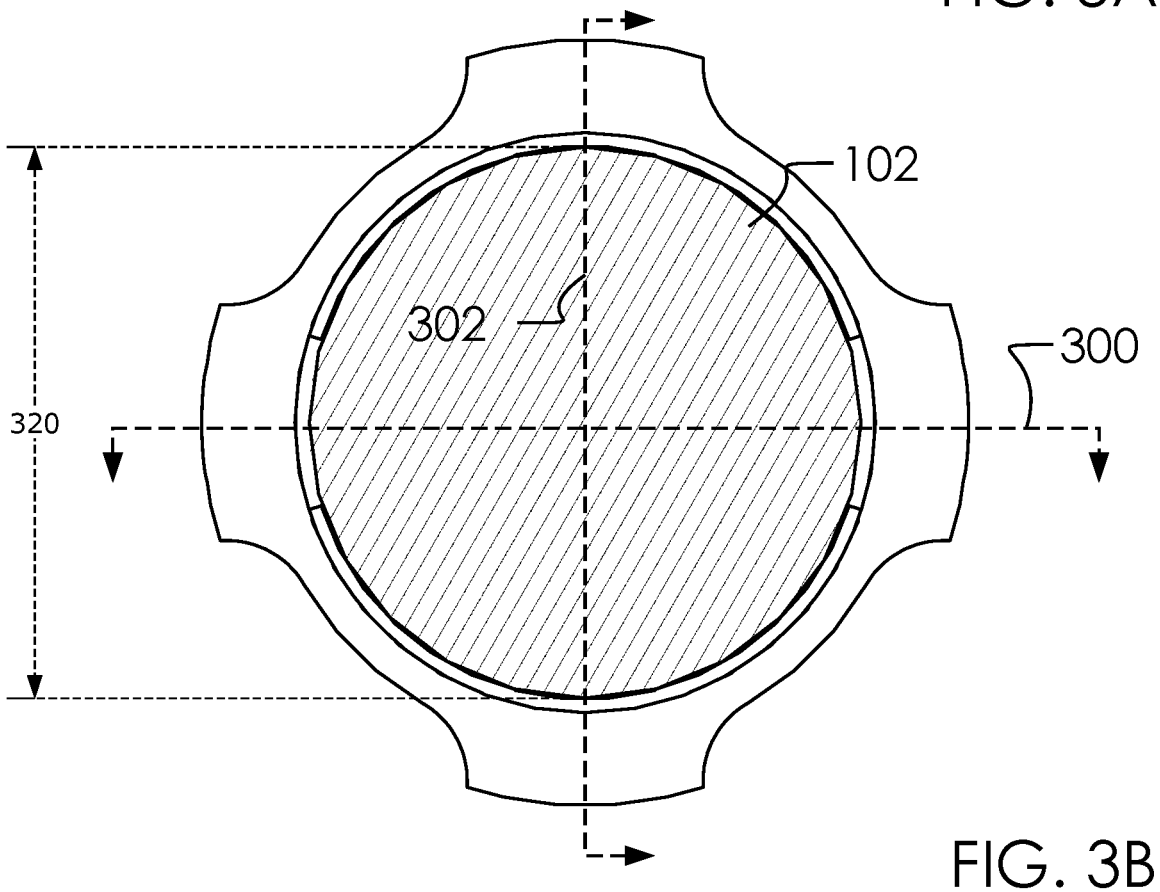

FIGS. 3A and 3B illustrate an elevated front view of said rod guide 100, with and without said sucker rod 102, respectively.

As illustrated, a horizontal section-cut 300 and a vertical section-cut 302 are shown for reference in figures to come.

In one embodiment, said rod guide 100 can comprise a plurality of flutes 304 arranged around a bore shell 306. Said plurality of flutes 304 can comprise a first flute 304*a*, a second flute 304*b*, a third flute 304*c* and a fourth flute 304*d*. Said rod guide 100 can comprise a plurality of glue dams 308 arranged around a guide bore 310.

Said guide diameter 202 can comprise a flute diameter 312, a shell diameter 314, an inner bore diameter 316 and an outer bore diameter 318. In one embodiment, said inner bore diameter 316 can be substantially the same or minimally larger than an outer rod diameter 320 of said sucker rod 102.

In one embodiment, said bore shell 306 can comprise a cylindrical shape with open ends at said first end 104*a* and said second end 104*b*.

Figure 4:
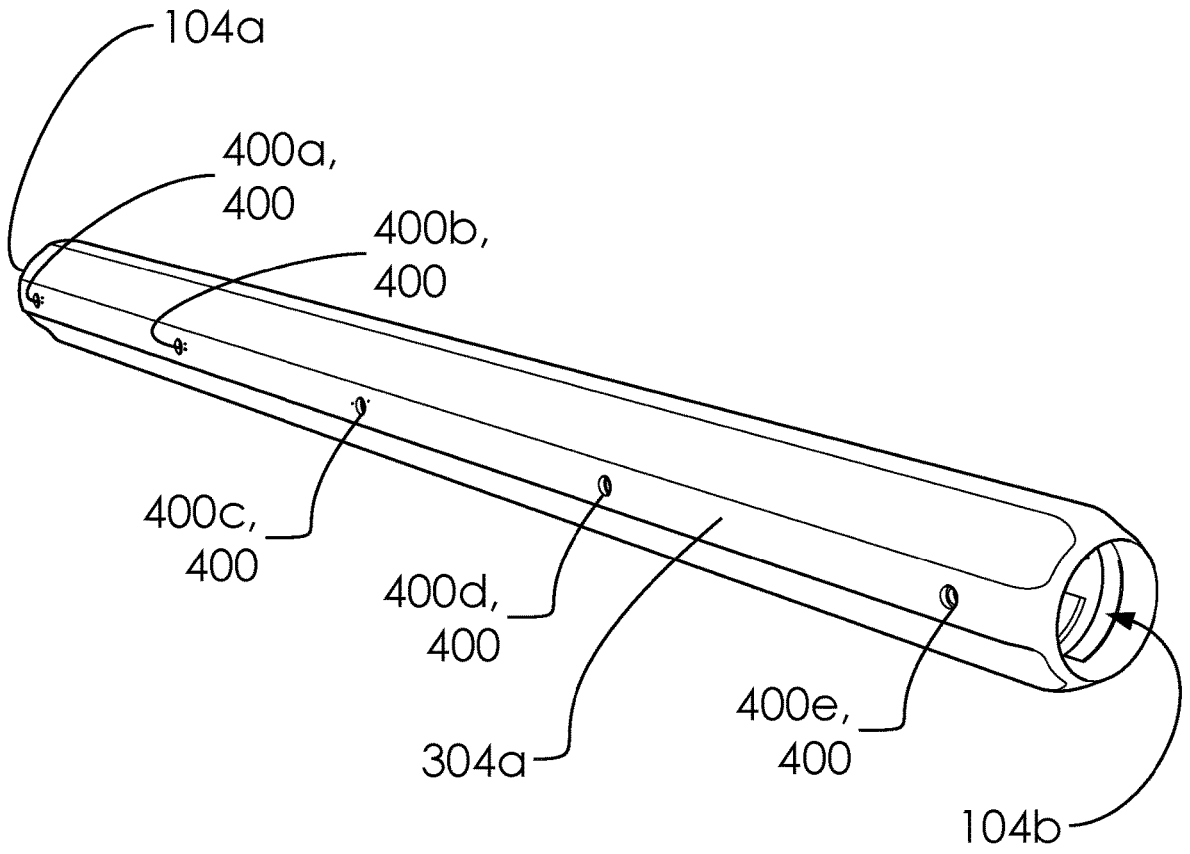
FIG. 4 illustrates a perspective overview of said rod guide 100 without said sucker rod 102.

FIG. 4 illustrates a perspective overview of said rod guide 100 without said sucker rod 102.

Said rod guide 100 can comprise one or more glue ports 400 (which can comprise a first glue port 400*a*, a second glue port 400*b*, a third glue port 400*c*, a fourth glue port 400*d*, a fifth glue port 400*e*, a sixth glue port 400*f*, a seventh glue port 400*g*, an eighth glue port 400*h*, a ninth glue port 400*k*, and a tenth glue port 400*m*). Illustrated here are glue ports 400*a*-400*e* in said first flute 304*a* with said first glue port 400*a* closest to said first end 104*a* and said fifth glue port 400*e* closest to said second end 104*b*. not illustrated are glue ports 400*f*-400*m*, which are similarly arranged between said first end 104*a* and said second end 104*b*.

Figure 5:
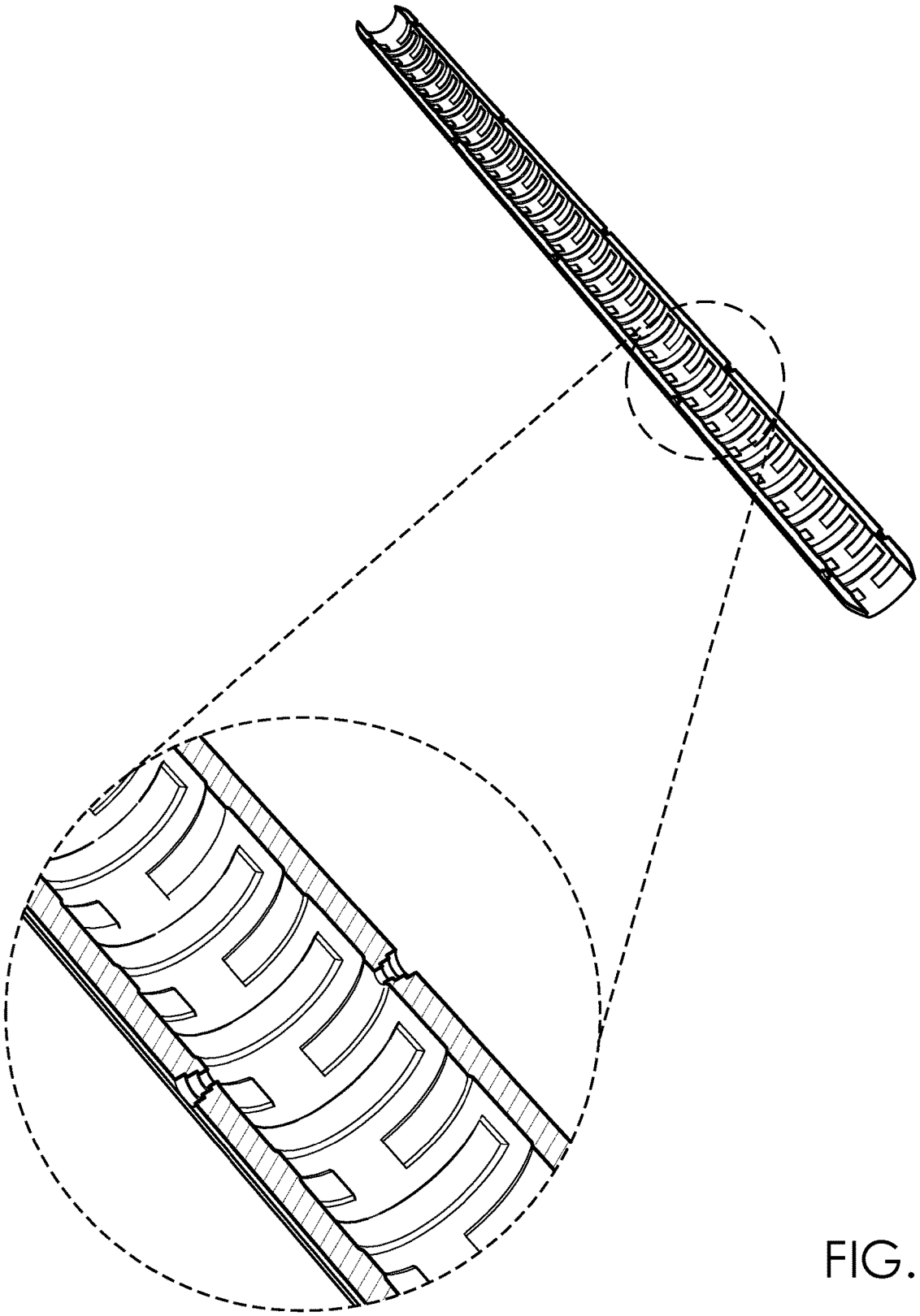
FIG. 5 illustrates a perspective overview of said rod guide 100 in cross-section along a horizontal section-cut 300, as well as a detailed call out view of said rod guide 100.

FIG. 5 illustrates a perspective overview of said rod guide 100 in cross-section along said horizontal section-cut 300, as well as a detailed call out view of said rod guide 100.

Figure 6:
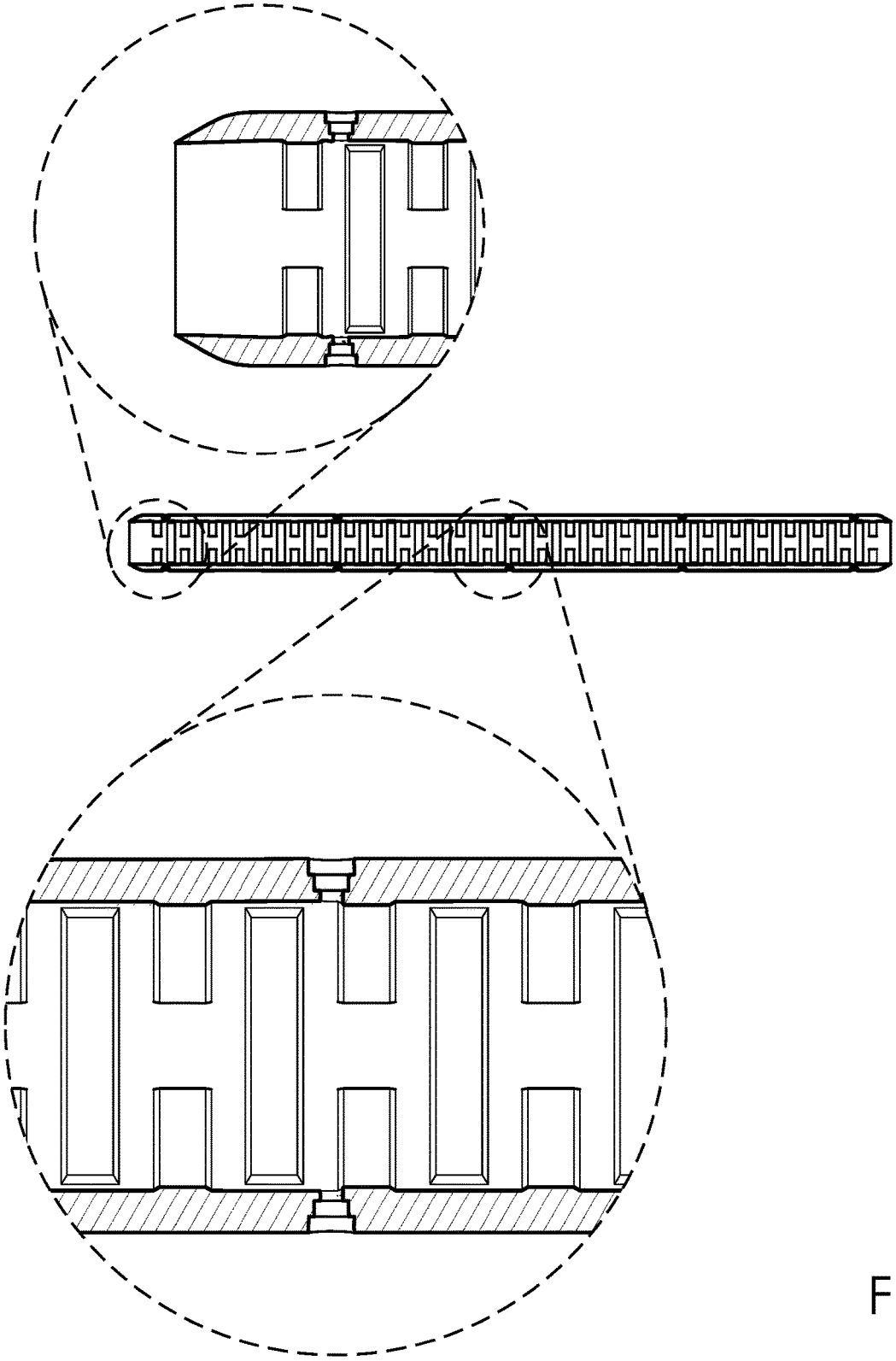
FIG. 6 illustrates an elevated top view of said rod guide 100 in a vertical section-cut 302 with two detailed call-out views.

FIG. 6 illustrates an elevated top view of said rod guide 100 in said vertical section-cut 302 with two detailed call-out views.

Figure 7:
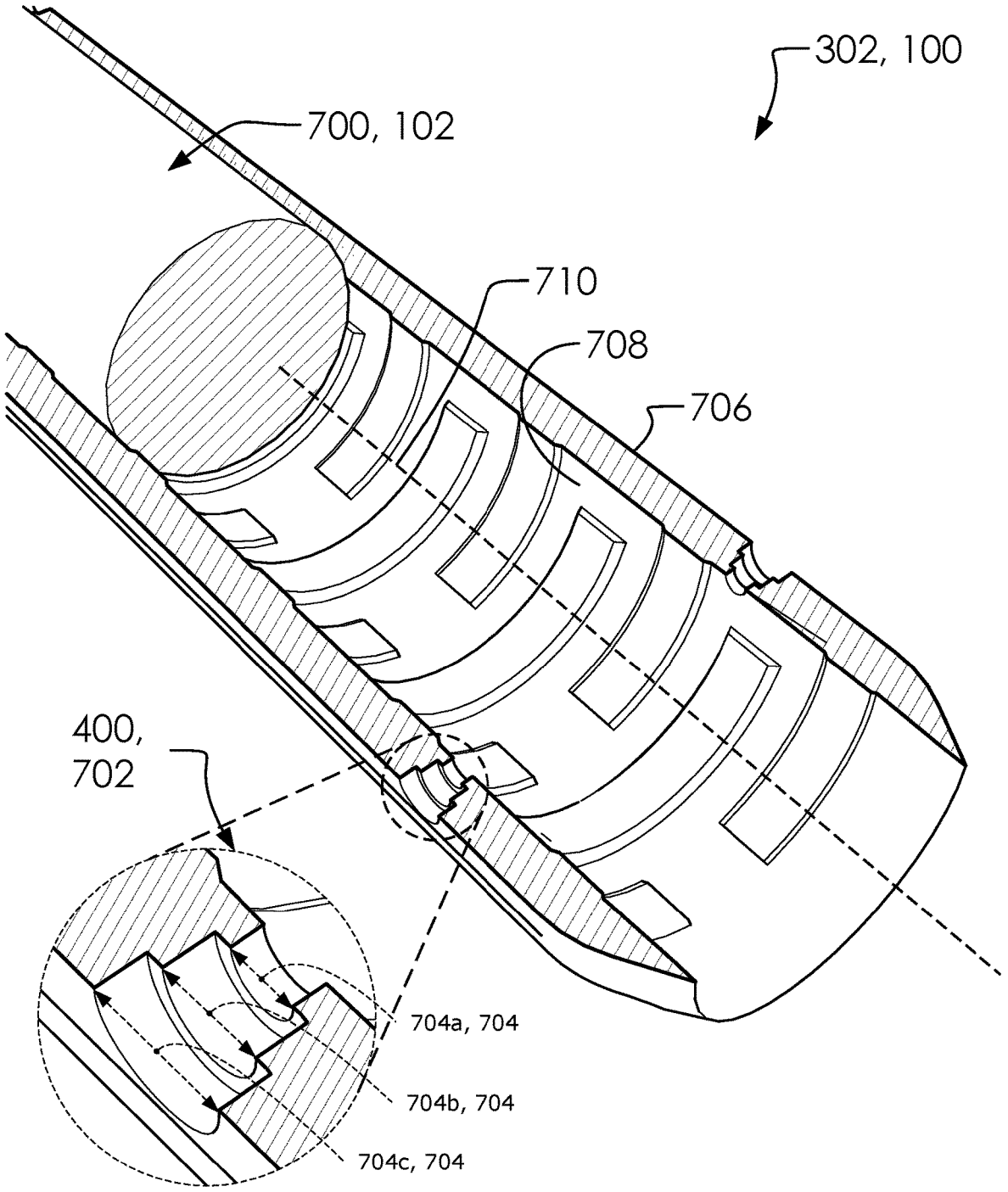
FIG. 7 illustrates a perspective overview of said vertical section-cut 302 of said rod guide 100 as well as a rod cross-section view 700 of said sucker rod 102, including a detailed call-out glue port view 702 of a first glue port 400*a*.

FIG. 7 illustrates a perspective overview of said vertical section-cut 302 of said rod guide 100 as well as a rod cross-section view 700 of said sucker rod 102, including a detailed call-out glue port view 702 of said first glue port 400*a*.

In one embodiment, said one or more glue ports 400 can each comprise an aperture in said bore shell 306 creating a fluid channel into said guide bore 310. In one embodiment, said one or more glue ports 400 can comprise one or more port diameters 704 (which can comprise a first port diameter 704*a*, a second port diameter 704*b*, and a third port diameter 704*c*). said one or more port diameters 704 can taper down as between an outside surface 706 and an inside surface 708 of said bore shell 306, with said first port diameter 704*a* being smaller than said second port diameter 704*b* and said third port diameter 704*c* being larger still.

In one embodiment, said rod guide 100 can be aligned along a central axis 710, corresponding to a longitudinal center of said rod guide 100 and said sucker rod 102.

Figure 8A:
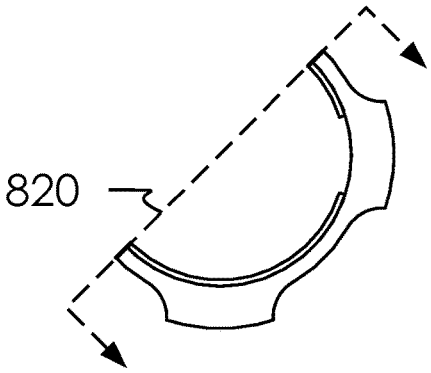
FIGS. 8A, 8B and 8C illustrate an elevated front view of said rod guide 100 with a diagonal section cut 820, an elevated front view, and a perspective overview of said rod guide 100 with said diagonal section cut 820.
Figure 8B:
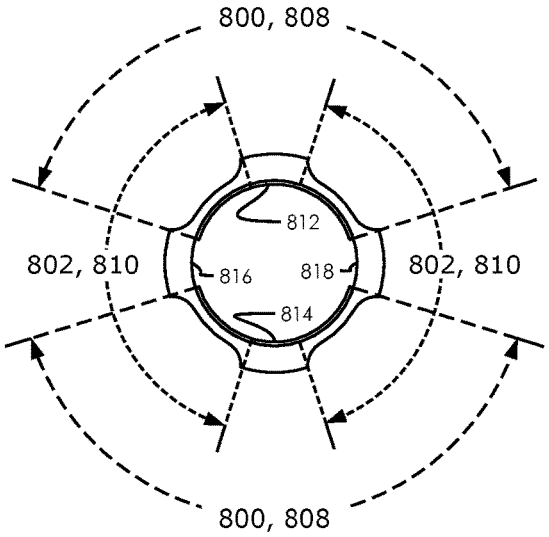
Figure 8C:
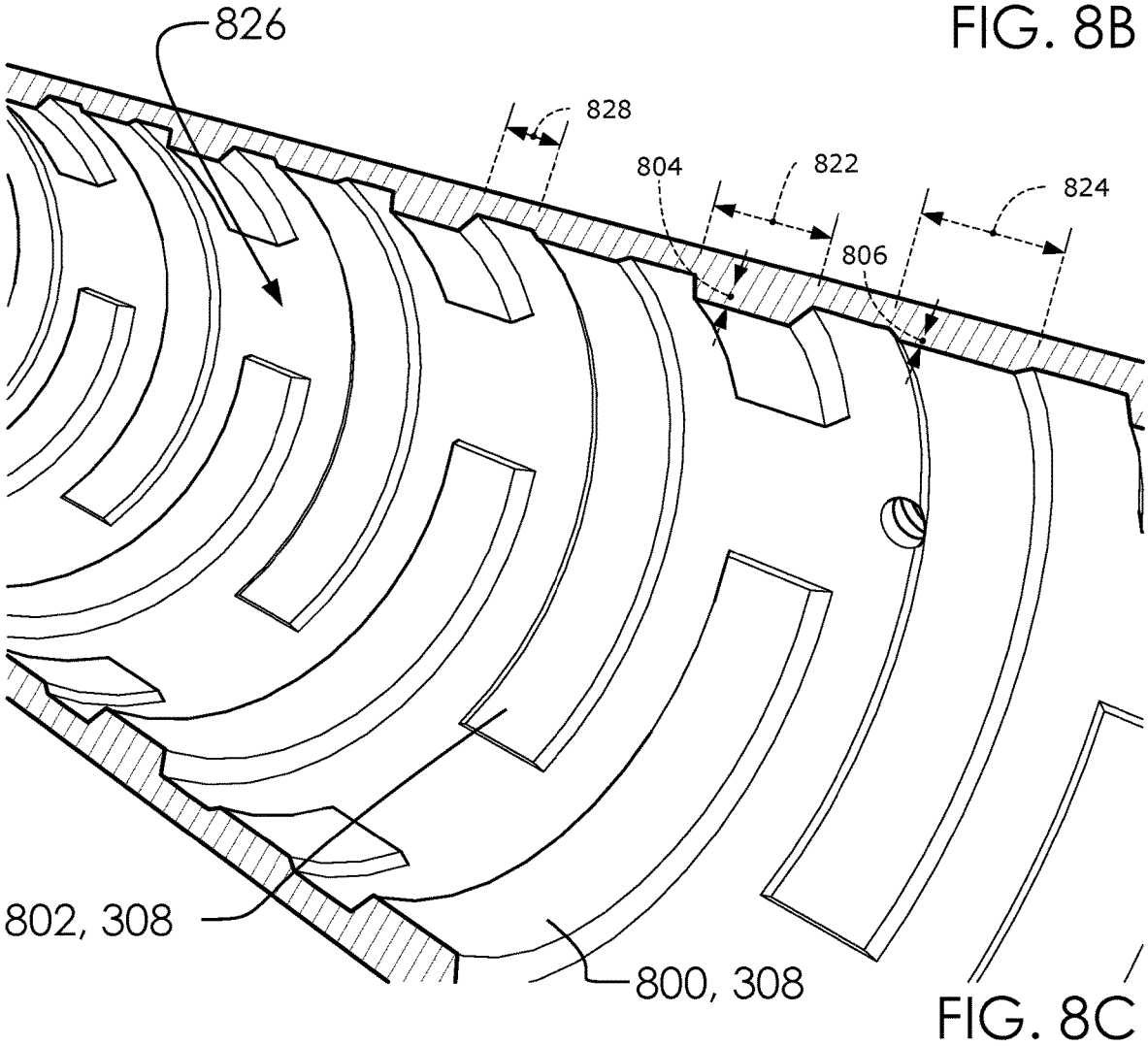

FIGS. 8A, 8B and 8C illustrate an elevated front view of said rod guide 100 with a diagonal section cut 820, an elevated front view, and a perspective overview of said rod guide 100 with said diagonal section cut 820.

In one embodiment, said plurality of glue dams 308 can comprise a plurality of horizontal dams 800 and a plurality of vertical dams 802 arranged about said inside surface 708 of said bore shell 306. Said diagonal section cut 820 can comprise a first thickness 804, and said plurality of vertical dams 802 can comprise a second thickness 806. In one embodiment, a portion of said plurality of glue dams 308 can comprise a different thickness from one another, for example said first thickness 804 can be thicker than said second thickness 806.

In one embodiment, said plurality of horizontal dams 800 can comprise a first radial width 808 and said plurality of vertical dams 802 can comprise a second radial width 810, as illustrated. Said plurality of horizontal dams 800 can be arranged on a top portion 812 and a bottom portion 814 of said inside surface 708, and said plurality of vertical dams 802 can be arranged on a first side 816 and a second side portion 818 of said inside surface 708, as illustrated.

In one embodiment, said plurality of horizontal dams 800 can comprise a first width 822 and said plurality of vertical dams 802 can comprise a second width 824. In one embodiment, said first width 822 can be equal to said second width 824. In one embodiment, each of said plurality of horizontal dams 800 and said plurality of vertical dams 802 can repeat in an alternating pattern along said inside surface 708 separated by an adhesive channel 826.

In one embodiment, said one or more glue ports 400 can be arranged between said plurality of glue dams 308 in said bore shell 306, as illustrated in FIG. 8C, to allow fluids such as an adhesive to enter said adhesive channel 826.

In one embodiment, each among said plurality of horizontal dams 800 and said plurality of vertical dams 802 can be arranged between said two ends 104 with a gap distance 828 between said plurality of horizontal dams 800 and said plurality of vertical dams 802, as illustrated. In one embodiment, said plurality of horizontal dams 800 and said plurality of vertical dams 802 can alternate along said rod guide 100.

Figure 9:
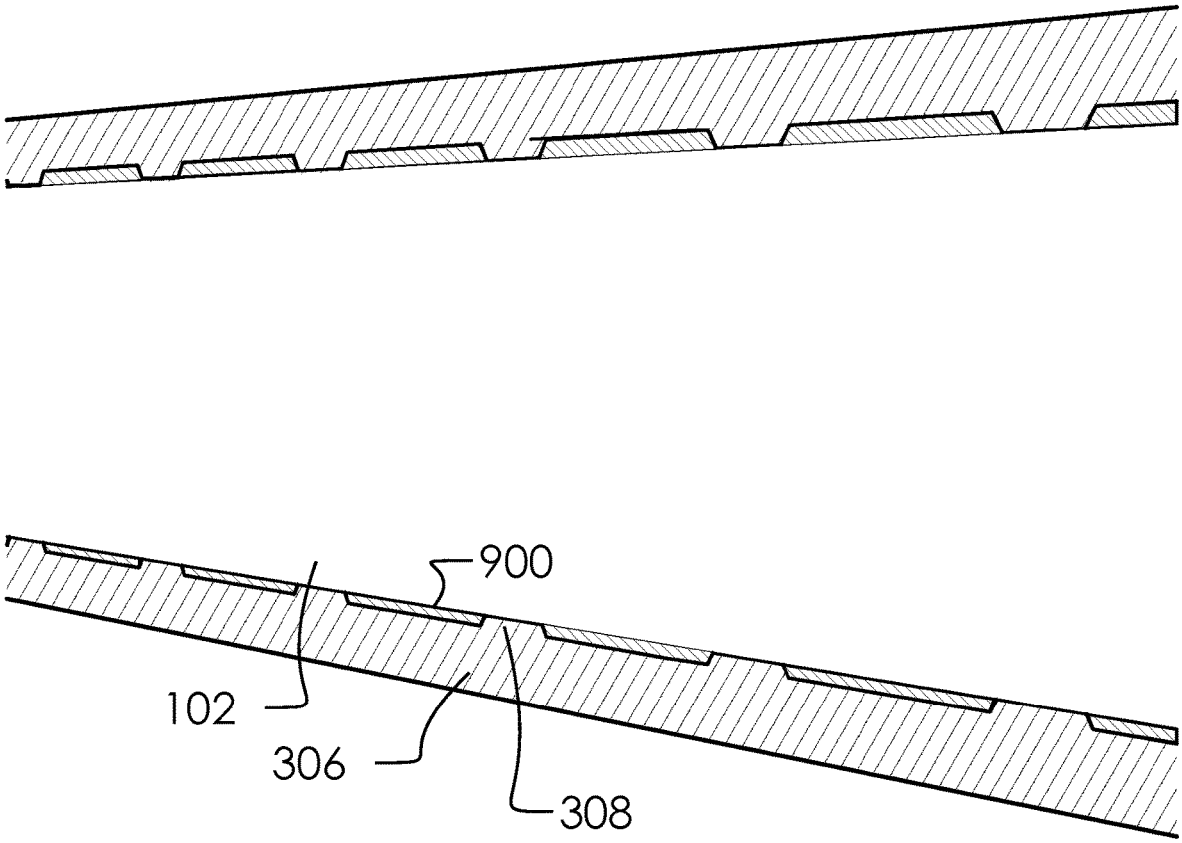
FIG. 9 illustrates a perspective overview of said rod guide 100 with said vertical section-cut 302.

FIG. 9 illustrates a perspective overview of said rod guide 100 and said sucker rod 102 with said vertical section-cut 302.

In one embodiment, said one or more glue ports 400 can allow an adhesive 900 to pass into said adhesive channel 826 between said plurality of glue dams 308 and said sucker rod 102.

Figure 10:
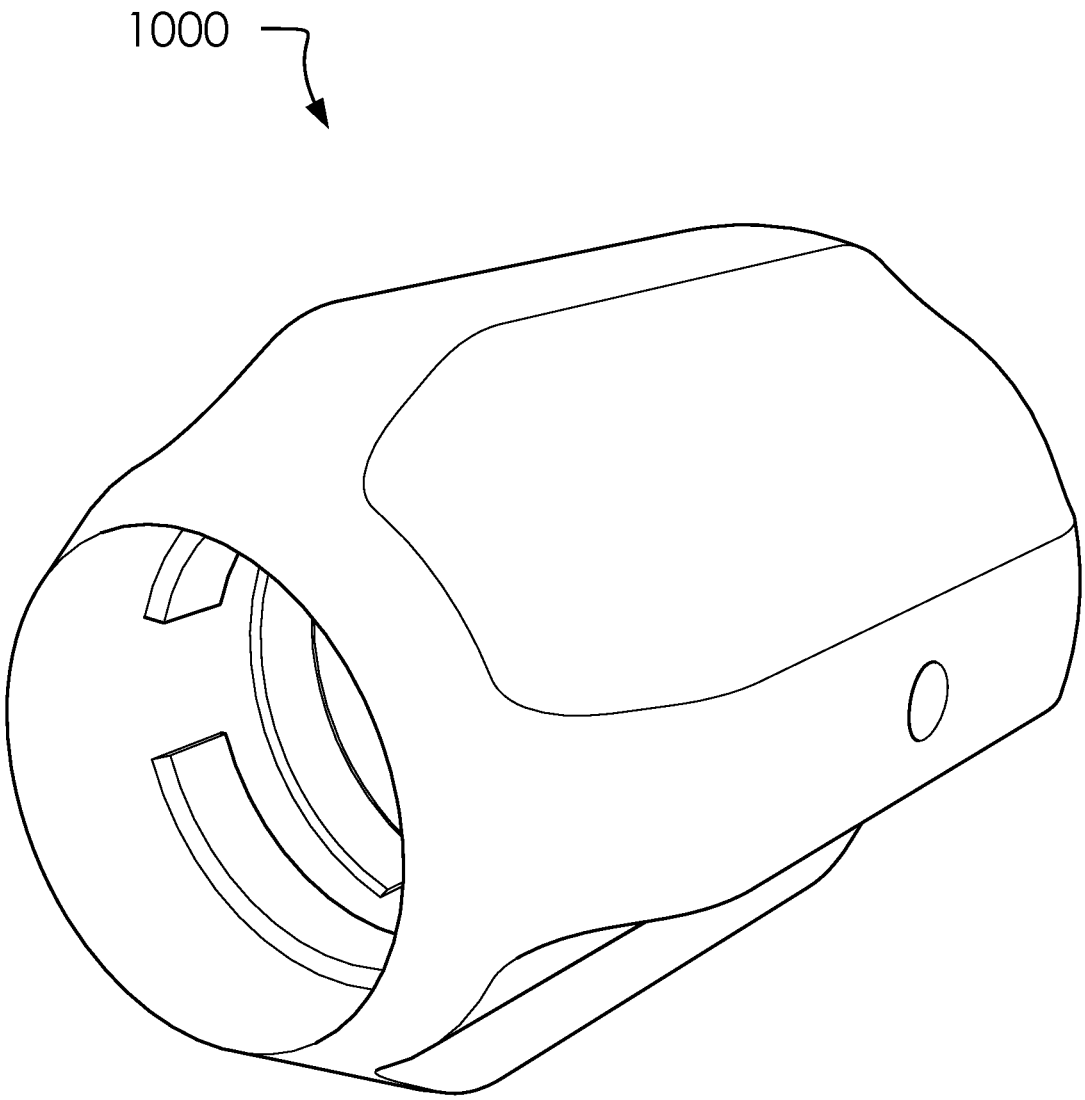
FIG. 10 illustrates a perspective overview of a short embodiment 1000 of said rod guide 100.

FIG. 10 illustrates a perspective overview of a short embodiment 1000 of said rod guide 100.

In one embodiment, said short embodiment 1000 can comprise similar features to said rod guide 100 but for a shorter length and fewer of said plurality of glue dams 308 and said one or more glue ports 400.

Figure 11A:
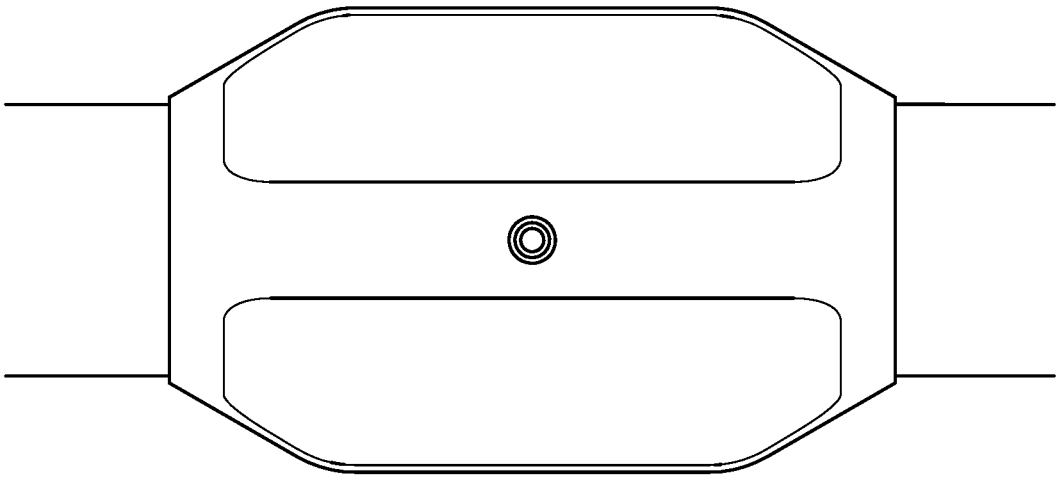
FIGS. 11A and 11B illustrate an elevated side view and top view of said short embodiment 1000.
Figure 11B:
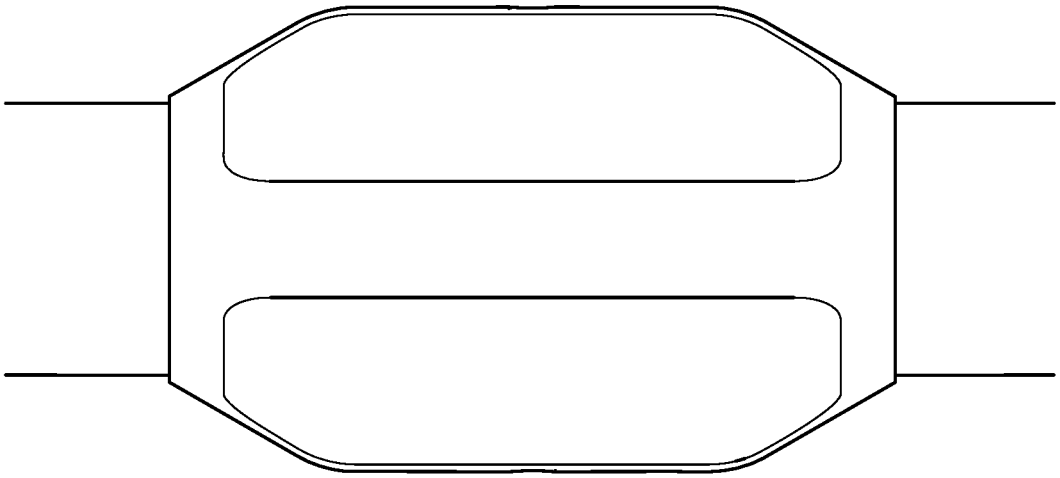

FIGS. 11A and 11B illustrate an elevated side view and top view of said short embodiment 1000.

Figure 12A:
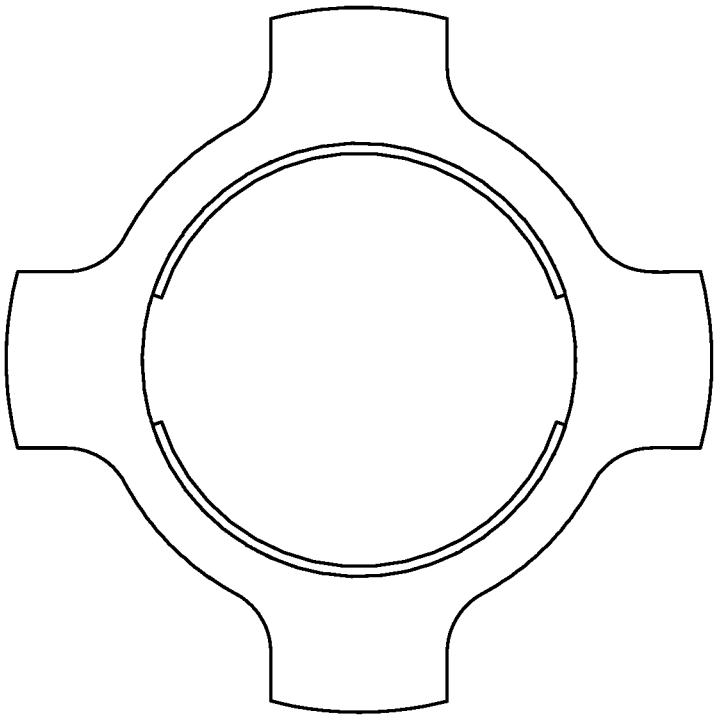
FIGS. 12A and 12B illustrate an elevated front view of said short embodiment 1000, with and without said sucker rod 102, respectively.
Figure 12B:
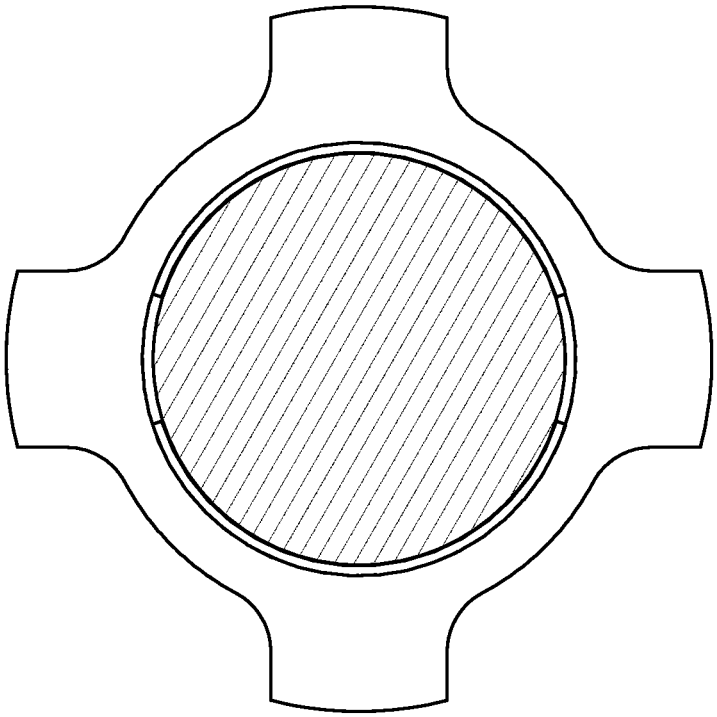

FIGS. 12A and 12B illustrate an elevated front view of said short embodiment 1000, with and without said sucker rod 102, respectively.

Figure 13:
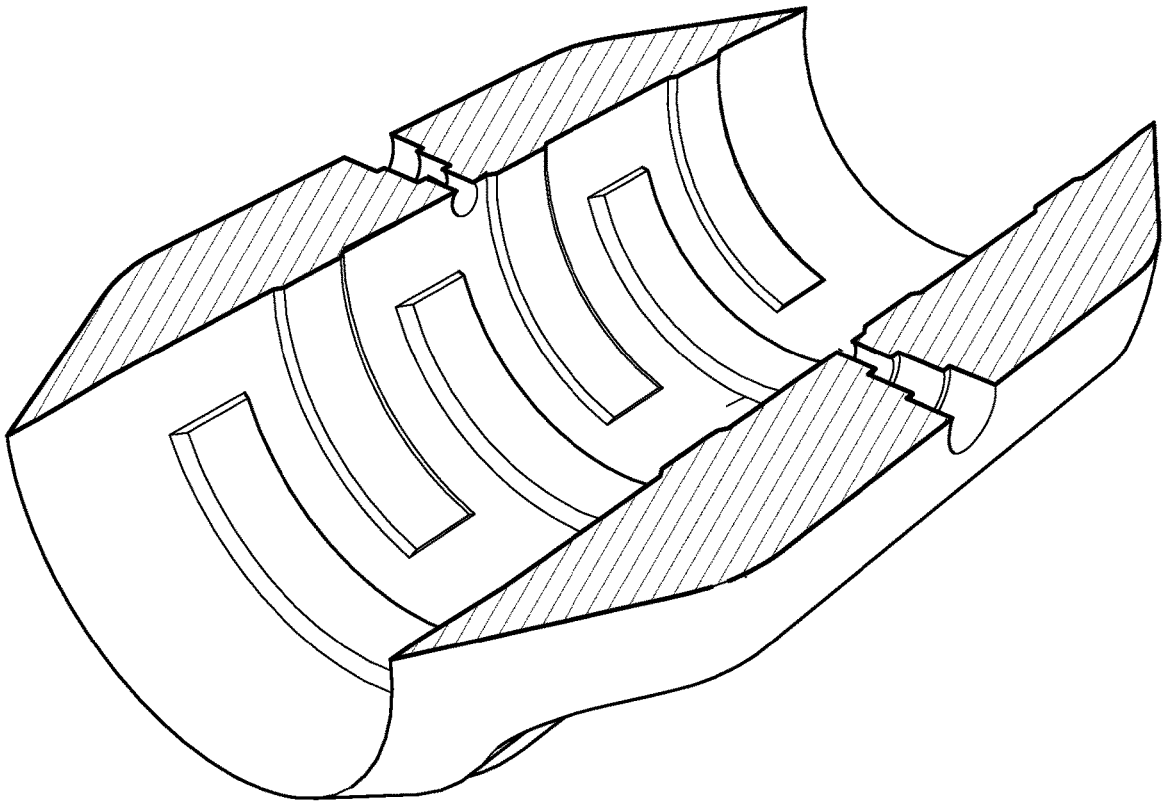
FIG. 13 illustrates a perspective overview of said short embodiment 1000.

FIG. 13 illustrates a perspective overview of said short embodiment 1000.

Figure 14:
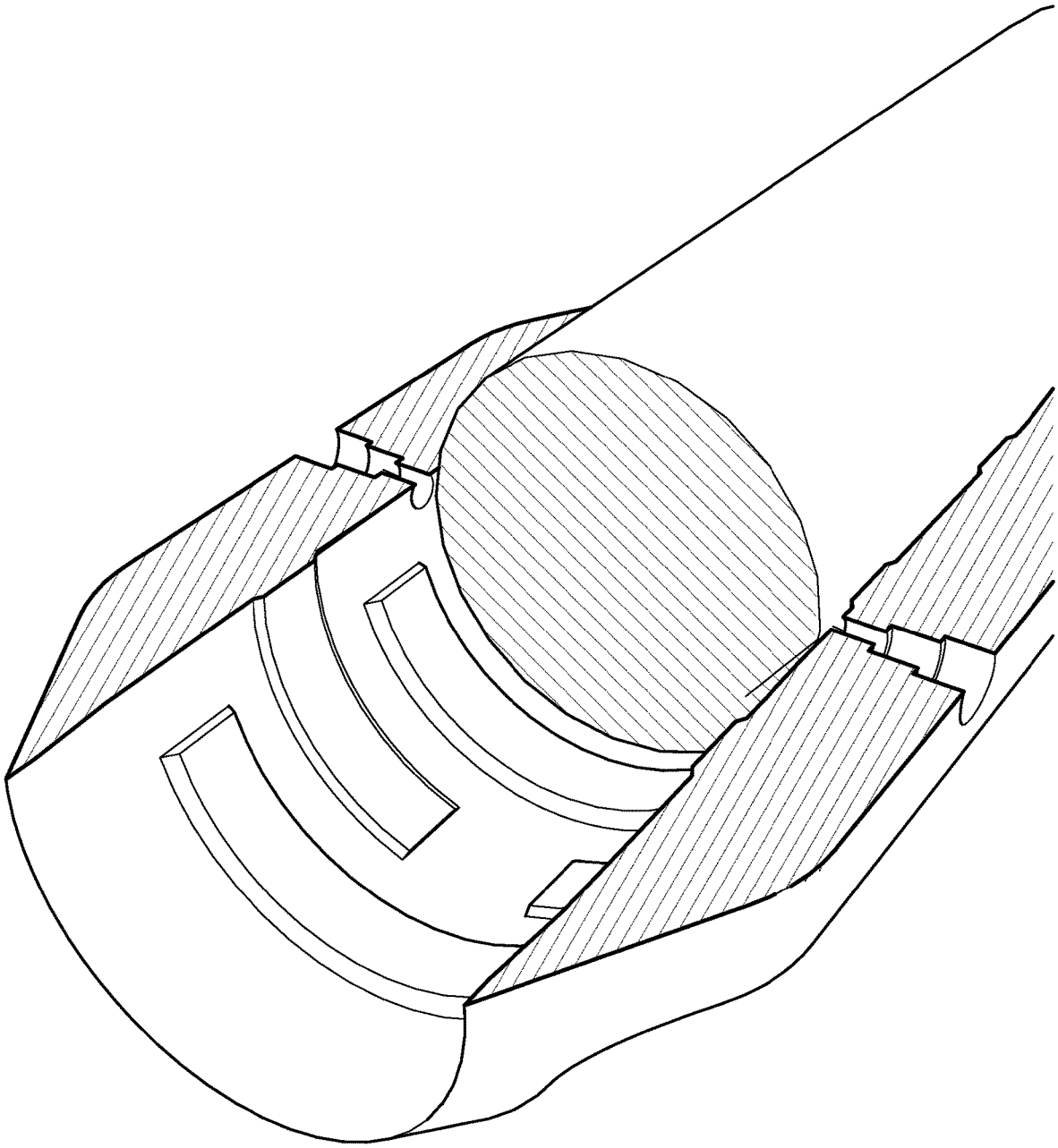
FIG. 14 illustrates a perspective overview of said short embodiment 1000 with said sucker rod 102.

FIG. 14 illustrates a perspective overview of said short embodiment 1000 with said sucker rod 102.

Figure 15:
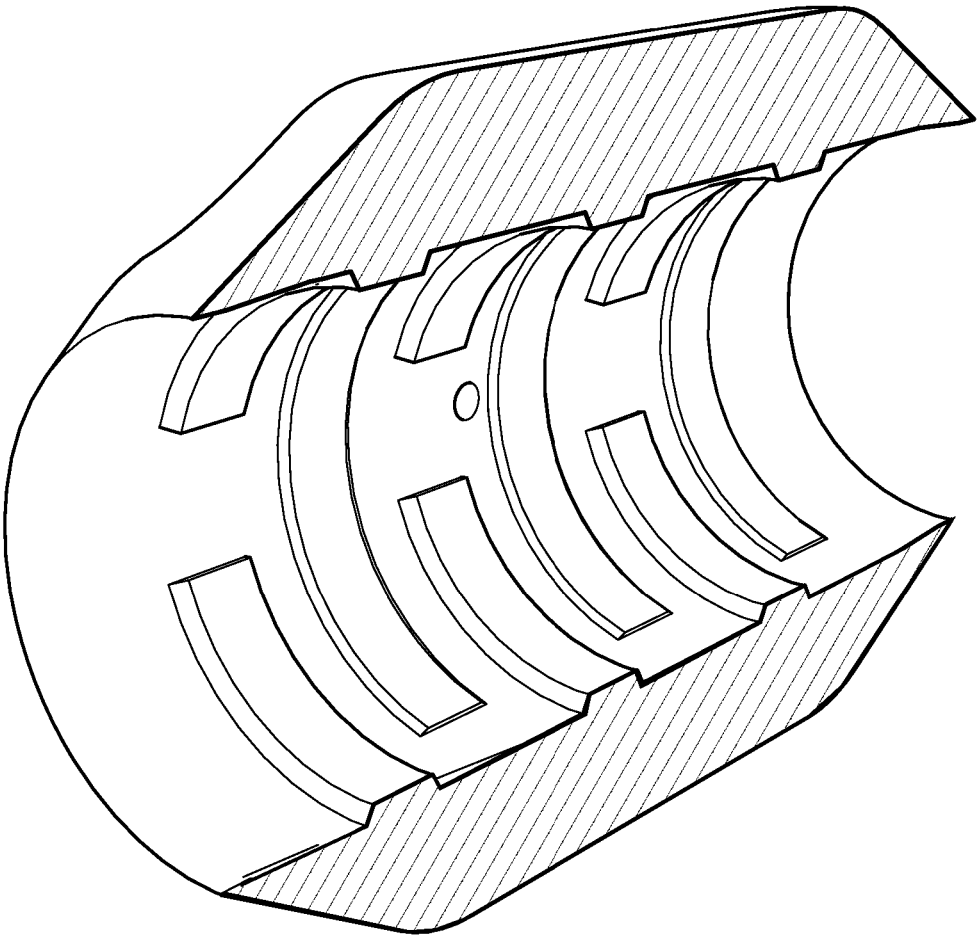
FIG. 15 illustrates a perspective overview of said short embodiment 1000.

FIG. 15 illustrates a perspective overview of said short embodiment 1000.

Figure 16:
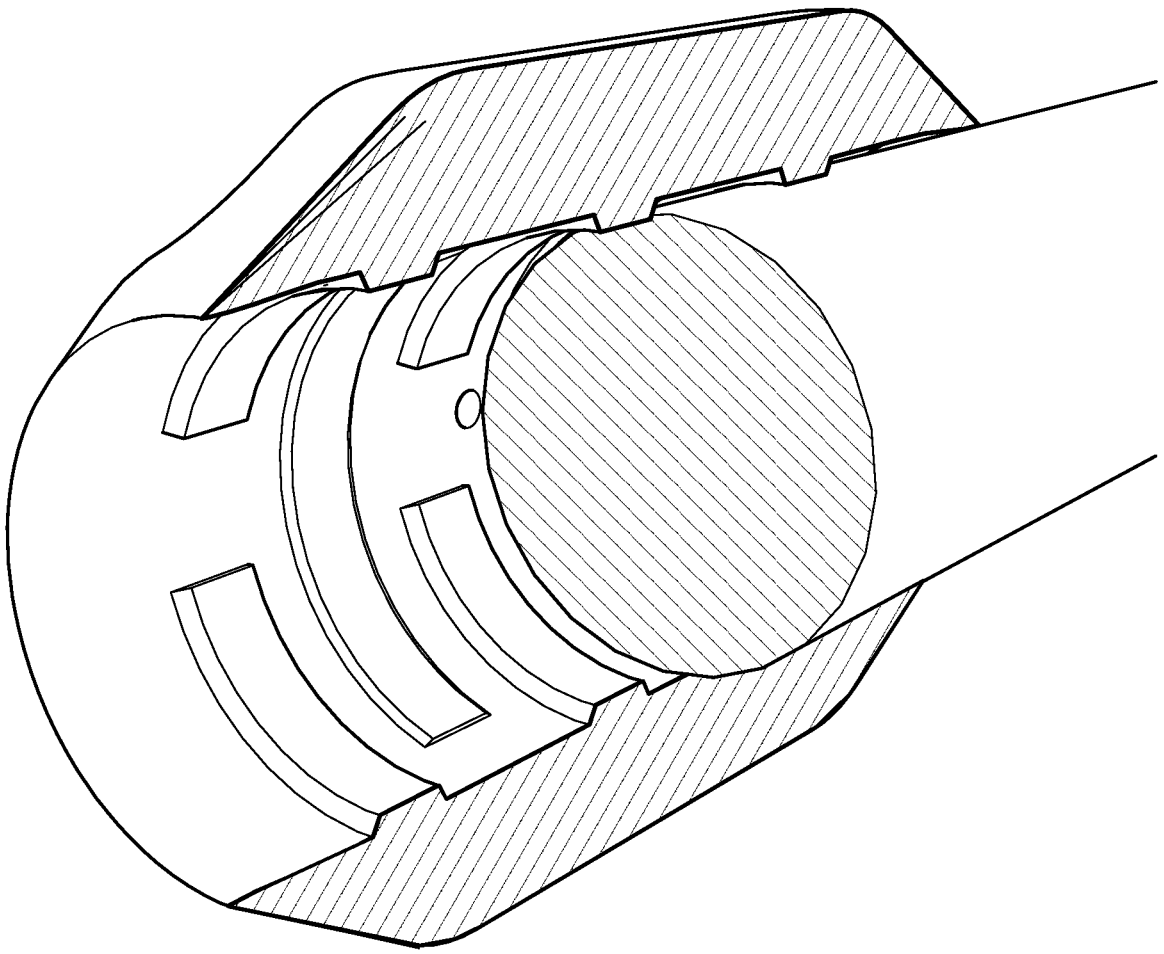
FIG. 16 illustrates a perspective overview of said short embodiment 1000 with said sucker rod 102.

FIG. 16 illustrates a perspective overview of said short embodiment 1000 with said sucker rod 102.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

These sentences are included with reference to the claims:

Said rod guide 100 for guiding and protecting said sucker rod 102 in a fluid mineral extraction setting. Said rod guide 100 comprising said bore shell 306, and said guide bore 310, said first end 104*a*, said second end 104*b*, said one or more glue ports 400, said plurality of glue dams 308 and said plurality of flutes 304. Said bore shell 306 wraps around said guide bore 310. Said bore shell 306 comprises said outside surface 706 and said inside surface 708. Said plurality of flutes 304 can be arranged around said bore shell 306 extending outward from said central axis 710. Said plurality of flutes 304 can be configured to prevent said sucker rod 102 from rubbing within a tubing, as said sucker rod 102 can be inserted and withdrawn from said tubing said rod guide 100 and said guide bore 310 comprises said central axis 710. Said plurality of flutes 304 comprises said flute diameter 312 as measured outward from said central axis 710. Said bore shell 306 comprises said shell diameter 314. Said guide bore 310 comprises said inner bore diameter 316 and said outer bore diameter 318. Said inner bore diameter 316 can be substantially the same or minimally larger than said outer rod diameter 320 of said sucker rod 102. Said one or more glue ports 400 each comprise an aperture in said bore shell 306 creating a fluid channel into said guide bore 310. Said plurality of glue dams 308 can be arranged about said inside surface 708 of said bore shell 306. Said one or more glue ports 400 can be arranged between said plurality of glue dams 308 in said bore shell 306 to allow said adhesive 900 to enter said adhesive channel 826. Said adhesive channel 826 can comprise a channel between said sucker rod 102, said bore shell 306, and said plurality of glue dams 308. Said one or more glue ports 400 each comprise said one or more port diameters 704. Said one or more port diameters 704 can taper down as between said outside surface 706 and said inside surface 708 of said bore shell 306. Said plurality of flutes 304 comprise at least said first flute 304*a*, said second flute 304*b* and said third flute 304*c*. Said bore shell 306 comprise a cylindrical shape with open ends at said first end 104*a* and said second end 104*b*.

Said rod guide 100 for guiding and protecting said sucker rod 102 in a fluid mineral extraction setting. Said rod guide 100 comprising said bore shell 306, and said guide bore 310, said first end 104*a*, said second end 104*b*, said one or more glue ports 400, said plurality of glue dams 308 and said plurality of flutes 304. Said bore shell 306 wraps around said guide bore 310. Said bore shell 306 comprises said outside surface 706 and said inside surface 708. Said plurality of flutes 304 can be arranged around said bore shell 306 extending outward from said central axis 710. Said plurality of flutes 304 can be configured to prevent said sucker rod 102 from rubbing within a tubing, as said sucker rod 102 can be inserted and withdrawn from said tubing said rod guide 100 and said guide bore 310 comprises said central axis 710. Said plurality of flutes 304 comprises said flute diameter 312 as measured outward from said central axis 710. Said bore shell 306 comprises said shell diameter 314. Said guide bore 310 comprises said inner bore diameter 316 and said outer bore diameter 318. Said inner bore diameter 316 can be substantially the same or larger than said outer rod diameter 320 of said sucker rod 102. Said one or more glue ports 400 each comprise an aperture in said bore shell 306 creating a fluid channel into said guide bore 310. Said plurality of glue dams 308 can be arranged about said inside surface 708 of said bore shell 306. Said one or more glue ports 400 can be arranged between said plurality of glue dams 308 in said bore shell 306 to allow said adhesive 900 to enter said adhesive channel 826. Said adhesive channel 826 can comprise a channel between said sucker rod 102, said bore shell 306, and said plurality of glue dams 308.

Said one or more glue ports 400 each comprise said one or more port diameters 704. Said one or more port diameters 704 taper down as between said outside surface 706 and said inside surface 708 of said bore shell 306.

Said one or more port diameters 704 comprise said first port diameter 704*a*, said second port diameter 704*b*, and said third port diameter 704*c*. Said first port diameter 704*a* can be smaller than said second port diameter 704*b*. Said second port diameter 704*b* can be smaller than said third port diameter 704*c*.

Said plurality of flutes 304 comprise at least said first flute 304*a*, said second flute 304*b* and said third flute 304*c*.

Said plurality of flutes 304 comprise at least said first flute 304*a*, said second flute 304*b*, said third flute 304*c* and said fourth flute 304*d*.

Said bore shell 306 comprise a cylindrical shape with open ends at said first end 104*a* and said second end 104*b*.

Said rod guide 100 can be aligned along said central axis 710, corresponding to a longitudinal center of said rod guide 100 and said sucker rod 102.

Said plurality of glue dams 308 comprise said plurality of horizontal dams 800 and said plurality of vertical dams 802. Said plurality of horizontal dams 800 comprise said first thickness 804, and said plurality of vertical dams 802 comprises said second thickness 806. a portion of said plurality of glue dams 308 comprises a different thickness from one another, for example said first thickness 804 can be thicker than said second thickness 806. Said plurality of horizontal dams 800 comprises said first radial width 808 and said plurality of vertical dams 802 comprises said second radial width 810. Said diagonal section cut 820 can be arranged on said top portion 812 and said bottom portion 814 of said inside surface 708, and said plurality of vertical dams 802 can be arranged on said first side 816 and said second side portion 818 of said inside surface 708. Said plurality of horizontal dams 800 comprises said first width 822 and said plurality of vertical dams 802 comprises said second width 824. Said first width 822 can be equal to said second width 824. each of said plurality of horizontal dams 800 and said plurality of vertical dams 802 repeat in an alternating pattern along said inside surface 708 separated by said adhesive channel 826. each among said plurality of horizontal dams 800 and said plurality of vertical dams 802 can be arranged between said two ends 104 with said gap distance 828 between said plurality of horizontal dams 800 and said plurality of vertical dams 802. Said plurality of horizontal dams 800 and said plurality of vertical dams 802 alternate along said rod guide 100.

Said plurality of horizontal dams 800 comprises said first width 822 and said plurality of vertical dams 802 comprises said second width 824. Said first width 822 can be equal to said second width 824.

a portion of said plurality of glue dams 308 comprises a different thickness from one another, for example said first thickness 804 can be thicker than said second thickness 806.

These parts are introduced in the specification and summarized here:

said rod guide 100,
said short embodiment 1000,
said sucker rod 102,
said two ends 104,
said first end 104*a*,
said second end 104*b*,
said guide length 200,
said guide diameter 202,
said horizontal section-cut 300,
said vertical section-cut 302,
said plurality of flutes 304,
said first flute 304*a*,
said second flute 304*b*,
said third flute 304*c*,
said fourth flute 304*d*,
said bore shell 306,
said plurality of glue dams 308,
said guide bore 310,
said flute diameter 312,
said shell diameter 314,
said inner bore diameter 316,
said outer bore diameter 318,
said outer rod diameter 320,
said one or more glue ports 400,
said first glue port 400*a*,
said second glue port 400*b*,
said third glue port 400*c*,
said fourth glue port 400*d*,
said fifth glue port 400*e*,
said sixth glue port 400*f*,
said seventh glue port 400*g*,
said eighth glue port 400*h*,
said ninth glue port 400*k*,
said tenth glue port 400*m*,
said rod cross-section view 700,
said detailed call-out glue port view 702,
said one or more port diameters 704,
said first port diameter 704*a*,
said second port diameter 704*b*,
said third port diameter 704*c*,
said outside surface 706,
said inside surface 708,
said central axis 710,
said plurality of horizontal dams 800,
said plurality of vertical dams 802,
said first thickness 804,
said second thickness 806,
said first radial width 808,
said second radial width 810,
said top portion 812,
said bottom portion 814,
said first side 816,
said second side portion 818,
said diagonal section cut 820,
said first width 822,
said second width 824,
said adhesive channel 826,
said gap distance 828, and
said adhesive 900.

The invention claimed is:

1. A rod guide for guiding and protecting a sucker rod in a fluid mineral extraction setting, wherein:

said rod guide comprising a bore shell, and a guide bore, a first end, a second end, one or more glue ports, a plurality of glue dams and a plurality of flutes;
said bore shell wraps around said guide bore;
said bore shell comprises an outside surface and an inside surface;
said plurality of flutes are arranged around said bore shell extending outward from a central axis;
said plurality of flutes are configured to prevent said sucker rod from rubbing within a tubing, as said sucker rod is inserted and withdrawn from said tubing
Said rod guide and said guide bore comprises said central axis;
said plurality of flutes comprises a flute diameter as measured outward from said central axis;
said bore shell comprises a shell diameter;
said guide bore comprises an inner bore diameter and an outer bore diameter;
said inner bore diameter is substantially the same or larger than an outer rod diameter of said sucker rod;
said one or more glue ports each comprise an aperture in said bore shell creating a fluid channel into said guide bore;
said plurality of glue dams are arranged about said inside surface of said bore shell;
said one or more glue ports are arranged between said plurality of glue dams in said bore shell to allow an adhesive to enter an adhesive channel;
said adhesive channel comprises a channel between said sucker rod, said bore shell, and said plurality of glue dams;
said plurality of glue dams comprise a plurality of horizontal dams and a plurality of vertical dams;

said plurality of horizontal dams comprise a first thickness, and said plurality of vertical dams comprises a second thickness;

said plurality of horizontal dams comprises a first radial width and said plurality of vertical dams comprises a second radial width;

said plurality of horizontal dams are arranged on a top portion and a bottom portion of said inside surface, and said plurality of vertical dams are arranged on a first side and a second side portion of said inside surface;

each of said plurality of horizontal dams and said plurality of vertical dams repeat in an alternating pattern along said inside surface separated by said adhesive channel; and said plurality of horizontal dams and said plurality of vertical dams alternate along said rod guide.

2. The rod guide of claim 1, wherein:

said one or more glue ports each comprise one or more port diameters; and said one or more port diameters taper down as between said outside surface and said inside surface of said bore shell.

3. The rod guide of claim 2, wherein:

said one or more port diameters comprise a first port diameter, a second port diameter, and a third port diameter;

said first port diameter is smaller than said second port diameter; and said second port diameter is smaller than said third port diameter.

4. The rod guide of claim 1, wherein:

said plurality of flutes comprise at least a first flute, a second flute and a third flute.

5. The rod guide of claim 1, wherein:

said plurality of flutes comprise at least said first flute, said second flute, said third flute and a fourth flute.

6. The rod guide of claim 1, wherein:

said bore shell comprise a cylindrical shape with open ends at said first end and said second end.

7. The rod guide of claim 1, wherein:

said rod guide is aligned along said central axis, corresponding to a longitudinal center of said rod guide and said sucker rod.

8. The rod guide of claim 1, wherein: a portion of said plurality of glue dams comprises a different thickness from one another; said plurality of horizontal dams comprises a first width and said plurality of vertical dams comprises a second width; said first width are equal to said second width; each among said plurality of horizontal dams and said plurality of vertical dams are arranged between a two ends with a gap distance between said plurality of horizontal dams and said plurality of vertical dams; and said plurality of horizontal dams and said plurality of vertical dams alternate along said rod guide.

9. The rod guide of claim 1, wherein:

each among said plurality of horizontal dams and said plurality of vertical dams are arranged between said two ends with a gap distance between said plurality of horizontal dams and said plurality of vertical dams.

10. The rod guide of claim 1, wherein:

said plurality of horizontal dams comprises a first width and said plurality of vertical dams comprises a second width; and said first width are equal to said second width.

11. The rod guide of claim 1, wherein:

a portion of said plurality of glue dams comprises a different thickness from one another.

12. A rod guide for guiding and protecting a sucker rod in a fluid mineral extraction setting, wherein:

said rod guide comprising a bore shell, and a guide bore, a first end, a second end, one or more glue ports, a plurality of glue dams and a plurality of flutes;

said bore shell wraps around said guide bore;

said bore shell comprises an outside surface and an inside surface;

said plurality of flutes are arranged around said bore shell extending outward from a central axis;

said plurality of flutes are configured to prevent said sucker rod from rubbing within a tubing, as said sucker rod is inserted and withdrawn from said tubing said rod guide and said guide bore comprises said central axis;

said plurality of flutes comprises a flute diameter as measured outward from said central axis;

said bore shell comprises a shell diameter;

said guide bore comprises an inner bore diameter and an outer bore diameter;

said inner bore diameter is substantially the same or larger than an outer rod diameter of said sucker rod;

said one or more glue ports each comprise an aperture in said bore shell creating a fluid channel into said guide bore;

said plurality of glue dams are arranged about said inside surface of said bore shell;

said one or more glue ports are arranged between said plurality of glue dams in said bore shell to allow an adhesive to enter an adhesive channel;

said adhesive channel comprises a channel between said sucker rod, said bore shell, and said plurality of glue dams;

said plurality of glue dams comprise are arranged on a top portion, a bottom portion a first side and a second side portion of said inside surface;

said plurality of glue dams create a non-symmetrical arrangement of said adhesive channel with reference to said central axis; and said plurality of glue dams being non-symmetrical causes said adhesive to adhere within said adhesive channel in an irregular pattern and therefore hold said rod guide more securely around said sucker rod.

* * * * *